United States Patent [19]

Portmann

[11] 4,030,284

[45] June 21, 1977

[54] CONTROL DEVICE FOR AN ELECTRONIC WRIST WATCH

[75] Inventor: Hubert Portmann, Colombier, Switzerland

[73] Assignee: Ebauches S.A., Neuchatel, Switzerland

[22] Filed: Nov. 25, 1975

[21] Appl. No.: 635,088

[30] Foreign Application Priority Data

Dec. 11, 1974 Switzerland ..... 16371/74

[52] U.S. Cl. ..... 58/23 R; 58/85.5; 307/247 A

[51] Int. Cl.[2] ..... G04C 3/00

[58] Field of Search ..... 58/23 R, 23 BA, 50 R, 58/85.5; 307/247 A

[56] References Cited

UNITED STATES PATENTS

| | | | |
|---|---|---|---|
| 3,672,155 | 6/1972 | Bergey et al. | 58/50 R |
| 3,823,550 | 7/1974 | Bergey | 58/50 R |
| 3,823,551 | 7/1974 | Riehl | 58/50 R X |
| 3,921,385 | 11/1975 | Harding et al. | 58/50 R X |

*Primary Examiner*—Ulysses Weldon
*Attorney, Agent, or Firm*—Imirie, Smiley & Linn

[57] ABSTRACT

A control device for an electronic wrist watch to enable resetting of the display. The device includes a pushbutton switch providing a control signal to a memory device. The memory device is connected to a delay means which transmits the information from said memory device in synchronism with a clock signal to provide an output pulse or pulse train dependent upon the length of time for which the pushbutton is actuated.

4 Claims, 3 Drawing Figures

CONTROL DEVICE FOR AN ELECTRONIC WRIST WATCH

BACKGROUND OF THE INVENTION

In electronic watches having digital displays, the resetting is, in general relatively difficult to effect. Although this is theoretically very simple, this operation sometimes takes the user more time than necessary. The reason is that each counter can only be advanced at a fixed rate. Compared with a mechanical resetting where one can approach more and more slowly to the desired indication, the electronic solution presents less flexibility. One could use two different methods of resetting, one method of advance which is rapid and one method of return which is rapid, which would approach the mechanical solution. However the electronic circuit then becomes much more complicated and the watch would have to possess additional push-buttons or, even, a function selection crown having more positions.

SUMMARY OF THE INVENTION

The invention proposes a control device which is more simple than known devices.

According to the present invention there is provided a control device for an electronic time-piece comprising a push button switch for providing a control signal, a memory element for memorizing said control signal and a delay means for transmitting information from the said memory element in synchronism with a clock signal, the said information transmitted by the delay means erasing the contents of the said memory element when the control signal has ceased.

BRIEF DESCRIPTION OF THE DRAWINGS

The present invention will be described further by way of example, with reference to the accompanying drawings, in which.

DETAILED DESCRIPTION OF THE DRAWINGS

Figure 1:
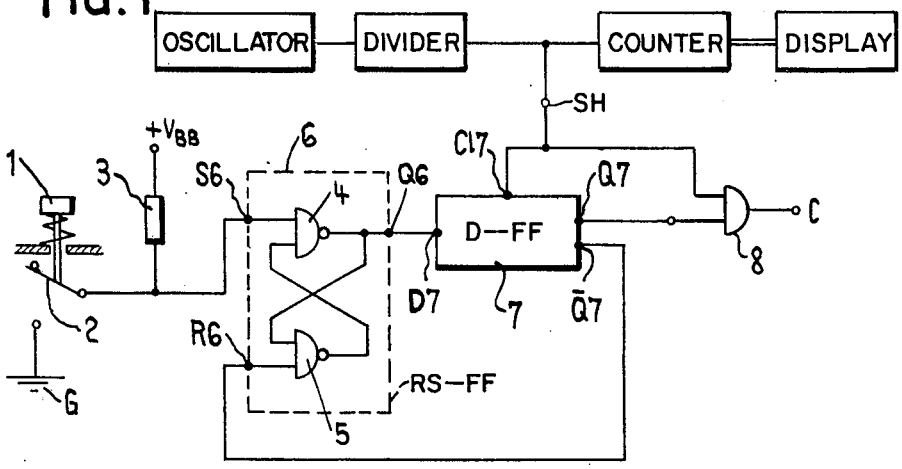
FIG. 1 shows an embodiment of the device in accordance with the invention.

In FIG. 1, a push-button 1 activates a switch 2 which connects a potential "0" at the input S6 of a RS flip-flop circuit 6 by connecting this input to earth G. When the switch 2 is open, the input S6 is at a potential "1", being connected to a supply voltage $+V_{BB}$ via a resistance 3. The RS flip-flop 6 is composed of two NAND gates 4 and 5 and its output Q6 is connected to the input D7 of a D flip-flop circuit 7. The input C17 of flip-flop 7 receives a clock signal SH which can come from one of the stages of the divider chain supplying the counters of the watch circuit. The frequency of this clock signal SH may, for example, be 1 Hz. The output $\overline{Q}7$ of the D flip-flop 7 is connected to the input R6 of the RS flip-flop 6. Remember here that in a D flip-flop the information presented at the input D7 passes to the output Q when the potential at the input C1 goes from "0" to "1". The output $\overline{Q}$ is at a complementary potential to the output Q.

Figure 2A:
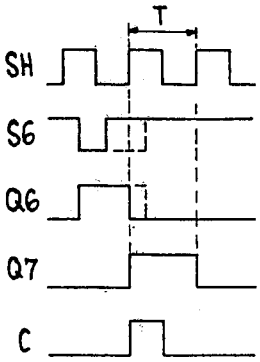
FIGS. 2A and 2B are diagrams illustrating the functioning of the device of FIG. 1.
Figure 2B:
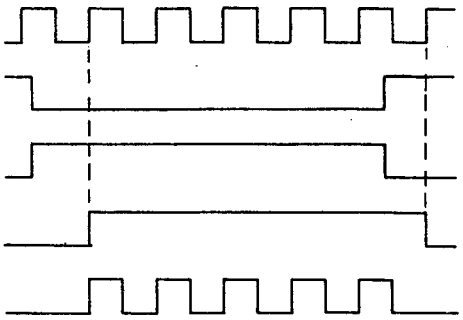

FIGS. 2A and 2B illustrate the functioning of the device described above. In FIG. 2A pressing the push-button 1 for a short instant provides a potential 0 at the input S6 of the RS flip-flop 6 which changes state so that the output Q6 goes to a potential 1 and remains there even after the input S6 is returned to a potential 1. On arrival of a positive going edge of the clock signal SH immediately following the arrival of the impulse at the input S6, the output Q7 of the D flip-flop 7 goes to a potential 1. If the negative impulse at the input S6 is already finished (full lines), the RS flip-flop 6 is returned to its initial state by the output $\overline{Q}7$ as soon as the D flip-flop 7 has changed state, if the impulse is still present at S6, then the RS flip-flop 6 would only return to its initial state at the moment when the push-button 1 was released (broken lines).

On the arrival of the second positive going edge of the clock signal immediately following the impulse given on the input S6, the D flip-flop 7 returns to its initial state, the positive impulse appearing at the outlet Q7 of the D flip-flop 7 has a duration corresponding exactly to one period T of the clock signal SH. Whatever the shortness of the impulse given to the switch 2, the RS flip-flop 6 will memorize it. The D flip-flop 7 switches for a period corresponding to a period of the clock signal SH.

In FIG. 2B, the application on the push-button 1 is longer, its duration comprises several periods of the clock signal SH. On the arrival of a positive going edge of the clock signal SH immediately following the passage from 1 to 0 of the potential at the input S6 of the RS flip-flop the output Q7 of the D flip-flop 7 passes to 1. The maintaining of a potential 0 at the input S6 provokes the maintaining of a potential 1 at the output Q6 thus at the input D7, the D flip-flop 7 remains switched. As soon as the push-button 1 is released, the input S6 passes to a potential 1 and the output Q6 falls to a potential 0. On the arrival of the next positive going edge of the clock signal SH immediately following the opening of the switch 2, the D flip-flop 7 returns to its initial state and its output Q7 falls to a potential 0.

It can be seen in the case of FIG. 2A, if the clock signal SH has a frequency of 1 Hz, that actuation of the push-button for a second at the maximum permits obtaining an impulse at the output Q7 of the flip-flop 7 the length of which will always be the same. If, for example. An AND gate 8 effects the logic product between logic data of the output Q7 and the clock signal SH, the result C shows (still in the case of FIG. 2A) that one will provide a single impulse which can be utilized to advance a counter of the watch by a single step. In the case of FIG. 2B impulses are provided as long as the push-button 1 is in the position illustrated in FIG. 1.

If the device is used in a resetting system, it will be easy for the user to control the advance of a counter by one, by applying a pressure on the push-button 1 for a time which is less than the period of the clock signal SH. If this latter has a frequency of 1 Hz, this period of time would have to be less than one second, which for the user poses no problems since he will not have to verify if the pressure on the push button was sufficiently long to obtain the desired effect. On the other hand, if it is desired to advance the counter several steps, the manipulation is the same as that which is necessary in known devices.

In certain types of watches, especially watches having an electrochromatic digital display, one can only proceed with a correction of the display at certain moments in that the elements of the display have, in their colouration or their dis-colouration, a certain inertia. The device in accordance with the invention working in synchronism with the clock signal SH can resolve the problems of synchronisation. In a general manner, the device in accordance with the invention lends itself to a use in all devices having synchronous logic.

We claim:

1. A control device of an electronic time-piece, comprising a push-button switch for providing a control signal, a memory element for memorizing said control signal, a delay means, a clock signal line, and a logic gate having inputs connected to an output of said delay means and to said clock signal line only, an input of said delay means being connected to said clock signal line, information from said memory element being transmitted in synchronism with a clock signal from said clock signal line through said delay means and said logic gate, the said information transmitted by the delay means erasing the contents of said memory element when the control signal has ceased.

2. A control device in accordance with claim 1, in which the memory element is an RS flip-flop circuit one of its inputs being connected to the push-button switch, and said delay means is a D flip-flop circuit the input of which is connected to an output of the RS flip-flop whilst the complementary output of said D flip-flop is connected to an input of the RS flip-flop circuit.

3. A control device in accordance with claim 1, wherein said logic gate is an AND gate.

4. A control device of an electronic time-piece, comprising a push-button switch for providing a control signal, an RS flip-flop for memorizing said control signal, a D flip-flop having an input connected to an output of said RS flip-flop, and AND-gate having two inputs, a clock signal line, the one input of said AND-gate being connected to an output of said D flip-flop and the other input of said AND-gate being connected to said clock signal line, the clock input of said D flip-flop being connected to said clock signal line and an output of said D flip-flop being connected to the reset input of said RS flip-flop, single clock controlled pulses or series of clock controlled pulses being transmitted from said AND-gate according to whether the push-button switch is closed for a short time or continuously.

* * * * *